United States Patent [19]

Heimberger

[11] 4,078,279

[45] Mar. 14, 1978

[54] SLIDE FASTENER WITH SEPARABLE ENDSTOP MEMBERS

[75] Inventor: Helmut Heimberger, Locarno, Switzerland

[73] Assignee: Optilon W. Erich Heilmann GmbH, Cham, Switzerland

[21] Appl. No.: 763,556

[22] Filed: Jan. 28, 1977

[30] Foreign Application Priority Data

Jan. 29, 1976 Germany ..... 2603241

[51] Int. Cl.[2] ..... A44B 19/00

[52] U.S. Cl. ..... 24/205.11 R

[58] Field of Search ..... 24/205.11 R, 205.11 F

[56] References Cited

U.S. PATENT DOCUMENTS 3,280,437 10/1966 Schwendt ..... 24/205.11 F

FOREIGN PATENT DOCUMENTS 38,450 5/1930 France ..... 24/205.11 R 282,353 10/1948 Switzerland ..... 24/205.11 R

*Primary Examiner*—Kenneth J. Dorner

*Attorney, Agent, or Firm*—Karl F. Ross

[57] ABSTRACT

A slide fastener with separable endstop members has a pair of stringer halves with respective rows of coupling members or heads adapted to interdigitate upon movement of a slide therealong. At an end of the stringer one of the slide fastener halves is provided with a pintle while the other slide half has its endstop member formed with a knuckle enabling one endstop member to pivot about the pintle axis relative to the other laterally and into the slider preparatory to closure of the slide fastener. A hook on one of the endstop members remote from the pintle engages the other endstop member to hold the two together. According to the invention, one of the endstop members forms a double armed lever fulcrumed between the pintle and the hook so that, upon engagement of the hook, the pintle is retained forcibly against its seat.

4 Claims, 7 Drawing Figures

SLIDE FASTENER WITH SEPARABLE ENDSTOP MEMBERS

FIELD OF THE INVENTION

The present invention relates to separable slide-fasteners and, more particularly, slide-fasteners stringers having a pair of interconnectible or interfittable endstop members which can be engaged for closure of the slide fastener or disengaged for separation of the two stringer halves at least at one end thereof. More particularly, the invention relates to slide-fastener stringers whose endstop members are interconnected with swingability.

BACKGROUND OF THE INVENTION

A slide-fastener stringer generally comprises a pair of stringer halves each formed with a support tape and, along an edge of this tape, with a row of coupling members, heads or links adapted to interdigitate with the heads or coupling members of the opposite stringer half upon movement of a slider therealong.

In the coupled state, each coupling member or head is received between a pair of coupling members or heads of the opposite row of coupling members, i.e. in an interhead space thereof, the head being generally provided with formations which lock one behind the other to prevent lateral forces, i.e. forces in the plane of the slide-fastener stringer, from causing separation of the stringer halves.

Of course, the coupling heads can have configurations intended to resist other types of stresses as well, i.e. forces perpendicular to the slide-fastener plane and torsional forces about the axis of the slide fastener.

Slide fasteners of this type can be made "separable", i.e. can be designed to permit at least one end and usually both ends of the slide fastener to separate from one another in the decoupled condition. Such slide fasteners are most common in garments, such as jackets, sweaters, coats, and have endstop members at this one end which can be locked together to permit the slider, upon movement from this end, to interdigitate the two rows of coupling members.

While linearly or arcuately insertable endstop members are most widely known and common, i.e. one endstop member is shifted generally along the slide-fastener axis into a channel or passage of the other endstop member and similarly into the channel or passage of the slider, it is also known to provide pivotable or swingable separable endstop members wherein one of the endstop members pivots upon the other and thus swings laterally into a laterally open channel of the slider. The present invention is primarily concerned with such swingable separable endstop members and, when reference is made hereinafter to the separability of the endstop members, it should be understood that it is this swingable type which is of concern.

In the conventional construction of swingable separable endstop members, one of these members is provided at one end with a pintle, pin, boss or other formation defining a pivot axis and receivable in a seat of the other endstop member to permit the relative swinging movement in the plane of the slide fastener. To ensure an effective locking of the two endstop members against the opposite pivotal movement which could lead to undesirable opening of the slide-fastener from this end after the slider has been moved away, complex locking elements are provided on the two members. These locking members which must be fabricated with high precision to interfit tightly are expensive, unreliable and prone to damage. Furthermore, it has been found, as a practical matter, to be difficult to interfit the locking elements and hence the two coupling members so that the manipulation of the slide-fastener is difficult and inconvenient.

OBJECTS OF THE INVENTION

It is an object of the invention to provide a separable slide-fastener of the swingable type whereby the aforementioned disadvantages are obviated, and which has simplicity of operation, high reliability and low fabrication costs.

It is another object of the invention to provide a separable slide-fastener of improved albeit simple construction.

Still another object of the invention is to provide an improved configuration of the interfittable endstop members of a separable slide-fastener whereby the complicated lock elements mentioned above are eliminated.

It is still another object of the invention to provide an improved slide fastener whose connectible endstop members are displaceable relatively with a swinging movement but have greater reliability than the prior-art systems against undesired openings.

SUMMARY OF THE INVENTION

These objections and others which will become apparent hereinafter are attained, in accordance with the present invention, in a slide-fastener of separable type, having generally the characteristics described previously, whose endstop members are relatively swingable. According to the invention, between the hinged end of the endstop member and the region remote from the hing axis at which they are locked together, e.g. by a hook or other releasable detente, one of the members 15 fulcrumed on the other member to act as a double arm lever such that the locking engagement of the two members presses the pin or pintle firmly against the wall of its seat, thereby securing the two members together more reliably than has hitherto been the case.

More particularly, one of the two members is formed with a slit, slot or channel accommodating a portion of the other endstop member which can be provided as a blade receivable in this slot, the fulcrum being likewise formed within the slot, e.g. between the base of the latter and the edge of the blade portion. The pintle or pivot pin is thus held forcibly against a wall of the knuckle or eye receiving same and, when this knuckle or eye is formed as a hook, generally against a wall remote from the opening into hook through which the pin is inserted.

The blade portion of the double-arm lever can, according to the invention, be provided over a region of its slide-fastener half from which the respective coupling members or heads have been removed (e.g. as described in my commonly assigned copending application Ser. No. 758,835, filed Jan. 12, 1977.

In such a slide-fastener the hinge pin can be provided on either of the members provided, of course, that the knuckle is formed on the other. Preferably the pin is provided on the swingable endstop member which forms the double arm lever so that the knuckle is provided upon the endstop member relative to which the swingable endstop member can pivot. This embodiment has been found to be particularly advantageous for manipulation of the endstop member, i.e. for the simple, reliable and rational insertion of the pin in the knuckle when the slide fastener is stitched into a garment or the like.

Accordingly to still another feature of the invention, in the region in which the first endstop member constituting the double-arm lever and provided with the blade has been freed from coupling members or heads. The opposite slide fastener half is provided with such coupling members or heads and each of the coupling members or heads has a slot opening toward the opposing slide -fastener half, the coupling members or heads in this region receiving the blade.

Furthermore, the slot of this second slide-fastener half can form the support point for the fulcrum of the double-arm lever and this can define the two lever arms thereof.

According to another feature of the invention, the pin and the knuckle receiving same can form a rotary lock which prevents withdrawal of the pin from the knuckle in the coupled state of the slide fastener. For example, the shape of the pin and the opening into the knuckle through which the pin is inserted can be chosen so that the pin can be introduced in an outwardly swung position of the double-arm lever and then rotated into the coupled position in which the pin cannot be withdrawn.

More specifically, the width of the pin in one direction can be less than its width in another direction, the first width corresponding to the breadth of the gap through which the pin is inserted. This can be achieved by flattening a cylindrical pin on one side.

The advantages of the slide fastener of the present invention will be immediately apparent since the fulcrum configuration ensures that the two coupling members can be easily brought into their coupled state and locked therein while all of the interengaged parts are maintained under a force tending to hold them in place. Complex locking elements are not required and undesired openings of the coupling members cannot occur.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
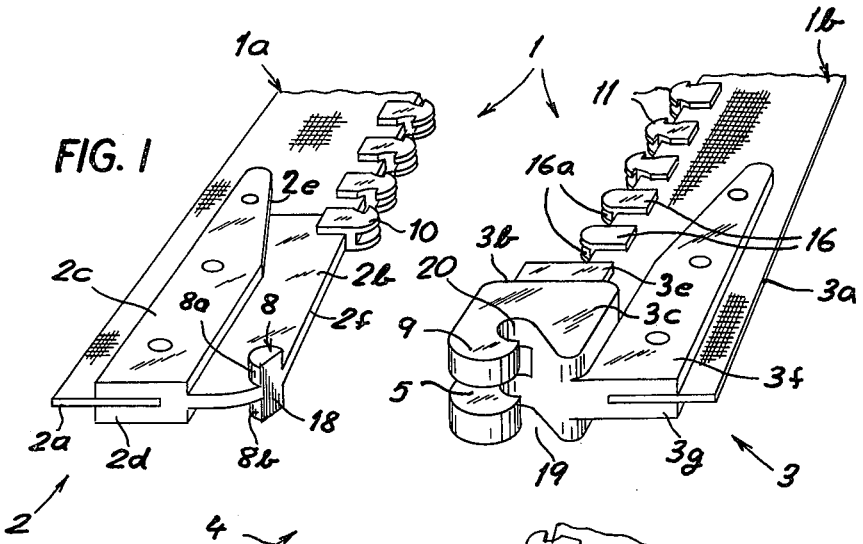
FIG. 1 is a perspective view, particular in diagrammatic form, of the endstop members of a slide fastener according to the invention in their decoupled state, drawn to greatly enlarged scale.

In the drawing I have shown a slide fastener having a separable end assembly generally represented at 1 the corresponding ends of respective stringer halves 1*a* and 1*b* each including respective support tape 2*a* and 3*a* upon which the endstop members 2 and 3 are respectively molded or otherwise attached, and inter-digitatable coupling members or heads 11 which can have, for example, the configuration shown and described in the aforementioned copending application or the literature cited therein.

Figure 2:
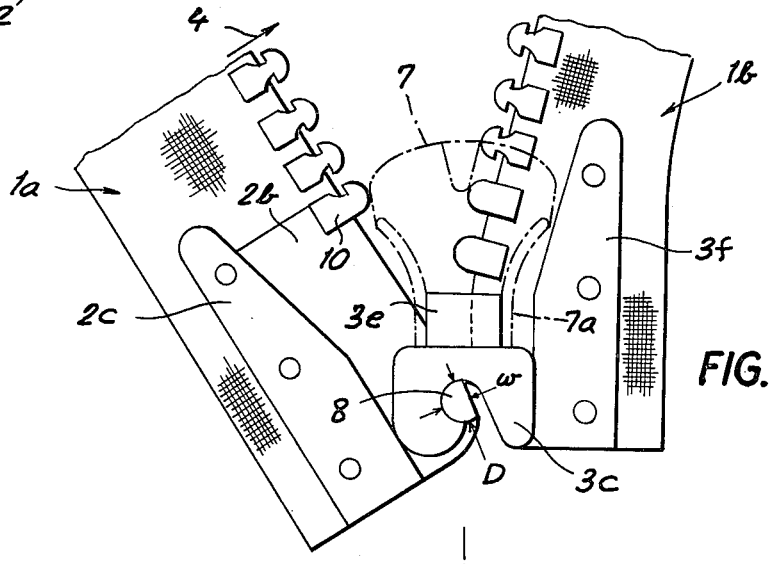
FIG. 2 is a plan view of the portion of the slide fastener shown in FIG. 1 but with the endstop members thereof in the position the pintle is initially inserted into the knuckle of the hinge joint by which the two endstop members are adapted to be coupled.

The endstop member 2 is provided with a blade portion 2*b* and a pair of ribs 2*c* and 2*d* flanking the tape 2*a*, these ribs having tapered portions 2*e* forming guides for a slider 7 when the latter is drawn downwardly into the position whown in FIG. 2. Withdrawal of the slider is prevented by an abutment 3*b* formed upon a block 3*c* of the endstop member 3, the block 3*c* having a projection 3*e* which is received in the tail 7*a* of the slider 7 to positively position the slider relative to the endstop members during closure thereof by the movement illustrated in FIG. 2 and represented by the arrow 4. The endstop member 3 also has a pair of ribs 3*f* and 3*g* flanking the tape 3*a*. Each of the endstop members is formed unitarily, e.g. by injection molding, from thermoplastic synthetic resin material.

Figure 3:
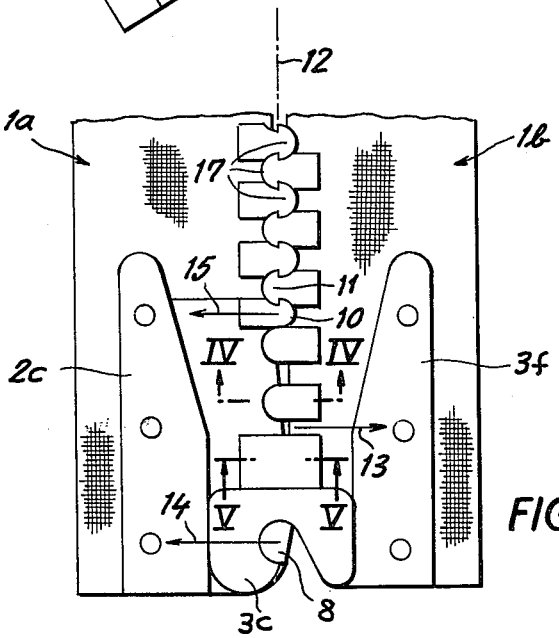
FIG. 3 is a veiw similar to FIG. 2 in which the endstop members are shown in their completely coupled state corresponding to the closed condition of the slide fastener.
Figure 4:
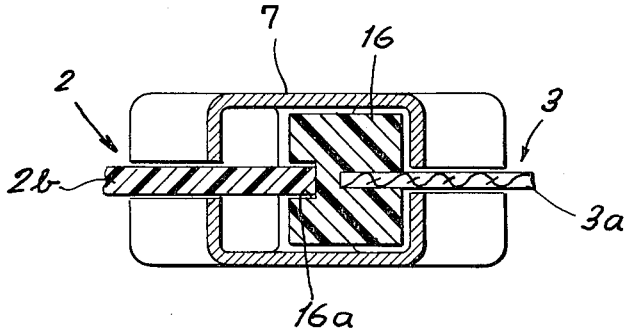
FIG. 4 is a cross-sectional view taken along line IV—IV of FIG. 3.

The block 3*c* and its projection 3*e* is formed with a laterally open slot or slit 5 adapted to receive the blade 2*b* and form an abutment for the edge 2*f* thereof (FIGS. 6 and 7) constituting the fulcrum of a double-arm lever as will be described in greater detail in connection with FIG. 3.

At its lower end, the endstop member 2 is provided with a hinge pin or pintle 8 which can consist of a pair of cylindrical projections 8*a* and 8*b* on opposite sides of the blade, these projections being received in a knuckle 9 of hook-shape provided in the block 3*c*. This knuckle has an opening 20 with a mouth or gap 19 whose width is such that it allows insertion of the pintle 8 in only one position (FIG. 2). To this end, the pintle 8 is flattened at 18 so that its width *w* in one direction is less than its diameter D, the gap 19 having a breadth between the dimension *w* and D.

Figure 5:
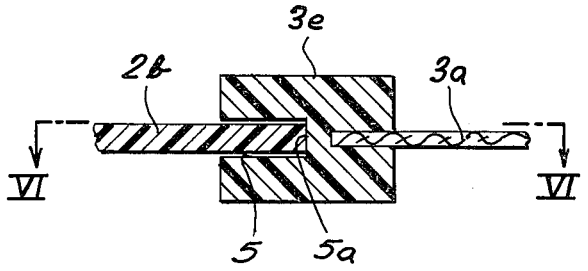
FIG. 5 is a cross section taken generally along the line V—V of FIG. 3.
Figure 6:
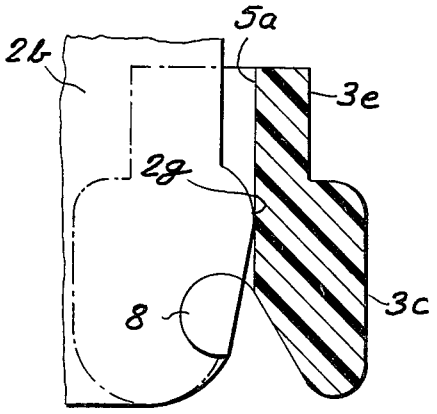
FIG. 6 is a view corresponding substantially to a cross section along the line VI—VI of FIG. 5 according to an embodiment of the invention.
Figure 7:
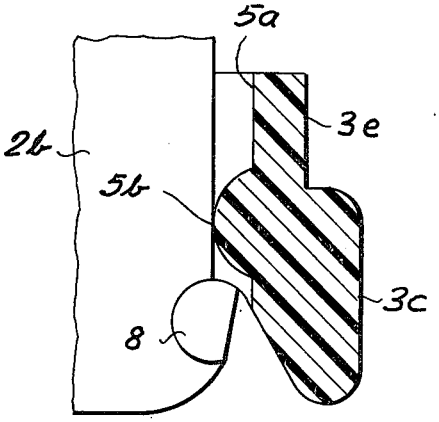
FIG. 7 is a view similar to FIG. 6 illustrating another embodiment thereof.

At its opposite end, the endstop member 2 is formed with a hook 10 engageable with one of the heads or coupling members 11 of the opposite slide-fastener half 3 to retain the coupling members in their closed condition. Between the hook 10 and the pin 8, the stringer half 1*a* is free from coupling heads or members although such members 16 are provided upon the opposite slide fastener half 1*b* and can have slots 16*a* adapted to receive the blade portion 2*b*. The wall 5*a* of the slot 5 against which the edge 2*f* of the blade bears (FIGS. 5 through 7) can be formed with a projection 5*b* (FIG. 7) to define the fulcrum. Alternatively, the edge 2*f* may be provided with a projection 2*g* which bears upon the wall 5*a* to define this fulcrum (FIG. 6).

As can be seen from FIG. 2, the pin 8 can be inserted through the gap 20 only in its outwardly swung diameter condition and that can be swung about the axis of this pin 8 to shift the blade portion 2*b* laterally through slider 7 and into the slot 16*a* of the teeth 16 (arrow 4) at hook 10 engaging one of the coupling membes 11. During this operation (FIG. 3) member 2 acts as a double arm lever which is fulcrumed between its pin 8 and its hook 10 so that it bears in the direction of arrow 13 upon the endstop member 3, the reaction forces developed at the hook 10 and the pin 8 being represented by the arrows 14 and 15. Member 2 is thus divided into a lever along the axes 12 of the slide fastener into a first arm between the fulcrum and the hook 10 and a second arm between the fulcrum and the pin 8 which is pressed against a wall of the knuckle 9 opposite the opening 20 into the latter. The force to the right can also be applied at the coupling members 15 and via the coupling head 17 of the slide fastener half 1*a* which interdigitate with the coupling heads 11 of slide fastener half 1*b*.

Of course, the hook 10 can be provided upon this latter slide-fastener half and can engage a formation on the endstop member 2 and the pin 8 and knuckle 9 can be expected between these end stop members.

I claim:

1. A slide fastener comprising a slider and a pair of slide-fastener halves each having a support tape formed with a row of coupling heads interdigitatable with the coupling heads of the other row and respective endstop members, one of said endstop members being elongated and flat and having a transverse pin at an end remote from the respective row of coupling heads and a hook at an end proximal to the respective row of coupling heads, the other endstop member being provided with a laterally open knuckle adapted to receive said pin and and a slot receiving at least a portion of said one of said members between said ends thereof, said knuckle having a portion reaching around said pin to prevent lateral withdrawal thereof in the direction parallel to said rows when said members are coupled together with said hook engaging a coupling head of the opposite slide fastener half, said opposite slide fastener half being formed with coupling heads at least in part receiving said one of said members, at least one of said members being formed with a projection within said slot constituting a fulcrum at which said one of said members is swingable to constitute a double arm lever pressing said pin into contact with a wall of said knuckle upon engagement of said hook.

2. The slide fastener defined in claim 1 wherein said knuckle has an inlet gap dimensioned with respect to said pin to permit insertion of said pin and withdrawal of said pin through said gap in only one relative angular position of said member.

3. The slide fastener defined in claim 2 wherein said one of said members is a blade and said other of said members is formed with a block provided with said slot adjacent said knuckle, said block receiving said blade and defining an abutment limiting the deplacement of said slider along said slide fastener.

4. The slide fastener defined in claim 3 wherein said block has an axial projection receivable in said slider and formed with said slot, said pin projecting in opposite directions from said blade and said knuckle being formed by a pair of hooks flanking said blade.

* * * * *